US006712146B2

(12) United States Patent
Estep et al.

(10) Patent No.: US 6,712,146 B2
(45) Date of Patent: Mar. 30, 2004

(54) DOWNHOLE ASSEMBLY RELEASABLE CONNECTION

(75) Inventors: James W. Estep, Houston, TX (US); Michael Chang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/998,125

(22) Filed: Nov. 30, 2001

(65) Prior Publication Data

US 2003/0102132 A1 Jun. 5, 2003

(51) Int. Cl.[7] ..... E21B 23/00

(52) U.S. Cl. ..... 166/377; 166/65.1; 166/66.4; 166/242.6; 166/242.7; 175/320

(58) Field of Search ..... 175/320; 166/65.1, 166/377, 242.6, 242.7, 66.4

(56) References Cited

U.S. PATENT DOCUMENTS

| | | | | |
|---|---|---|---|---|
| 4,463,814 A | | 8/1984 | Horstmeyer et al. | 175/45 |
| 5,257,663 A | * | 11/1993 | Pringle et al. | 166/66.4 |
| 5,323,853 A | * | 6/1994 | Leismer et al. | 166/55 |
| 5,394,951 A | | 3/1995 | Pringle et al. | 175/61 |
| 5,762,142 A | | 6/1998 | Connell et al. | 166/325 |
| 5,984,006 A | | 11/1999 | Read et al. | 166/63 |
| 6,032,733 A | | 3/2000 | Ludwig et al. | 166/60 |

FOREIGN PATENT DOCUMENTS

EP 0911483 A2 4/1999

* cited by examiner

*Primary Examiner*—David Bagnell
*Assistant Examiner*—G M Collins
(74) *Attorney, Agent, or Firm*—Conley Rose, P.C.

(57) ABSTRACT

A disconnect assembly connecting two portions of a downhole assembly having a downhole apparatus attached to a coiled tubing string. The disconnect assembly includes a first housing connected to one portion of the downhole assembly and a second housing connected to another portion of the downhole assembly. The housings are releasably connected by a release assembly. The release assembly is coupled to a drive train on a motor by a connection transferring rotational motion into translational motion. The release assembly includes locking members having a connected position engaging both housings and a released position wherein the housings can be separated. The motor is connected to the surface by conductors extending through the coiled tubing whereby the motor may be actuated from the surface to move the release assembly between the connected and disconnected positions.

17 Claims, 6 Drawing Sheets

DOWNHOLE ASSEMBLY RELEASABLE CONNECTION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a releasable connection for a downhole assembly and more particularly to a releasable connection connecting a downhole tool to a coiled tubing string and still more particularly to a connection electrically actuated from the surface to disengage the coiled tubing string from a stuck downhole drilling tool or bottom hole assembly (BHA).

2. Description of the Related Art

Increasingly, the drilling of oil and gas wells is no longer a matter of drilling a vertically straight bore hole from the surface to the desired hydrocarbon zone. Rather, technology and techniques, such as directional drilling, have been developed to drill deviated, lateral or sometimes upwardly sloping boreholes. It is often not economically feasible or practical to use jointed drill pipe in extended reach wells. Therefore, tools and methods have been developed for drilling bore holes using coiled tubing, which may include one or more lengths of continuous, unjointed tubing spooled onto reels for storage in sufficient quantities to exceed the maximum length of the borehole. The coiled tubing may be metal coiled tubing or, using more current technology, composite coiled tubing.

In well drilling applications, a BHA, having various components, such as a downhole motor, steering assembly, and bit, is connected to the end of a coiled tubing string for drilling the borehole. Circumstances can arise in which it is desirable to disconnect the tubing string from the BHA, such as, for example, when the BHA gets stuck in the borehole during drilling and the tubing string must be disconnected from the BHA in order to facilitate fishing, jarring, or other operations for retrieving the BHA.

In using jointed pipe for drilling, torque can be applied to the threaded connections to actuate traditional disconnect means to disconnect the BHA. However, when using continuous tubing, such as metal or composite coiled tubing, torque can not be applied to disconnect the tubing string from the BHA, and an axial disconnection means must be utilized. Pre-installation of one or more axial release devices between the tubing string and the BHA assembly can provide a means to disconnect the coiled tubing string downhole if and when disconnection becomes necessary.

A variety of axial disconnect means have been used to disconnect a coiled tubing string, some of which use hydraulic or electrical lines that extend from the surface to the disconnect means to actuate a piston and cause release. One such device, described in U.S. Pat. No. 5,984,006, includes an emergency release tool that can electrically release coiled tubing from one or more downhole tools. The release tool includes a releasable slip forced against the coiled tubing by a loading nut. The coiled tubing is released by sending an electrical signal to a downhole release means. Once activated, the release means forces a piston upward until the piston engages a slip housing. The slip housing is coupled to the loading nut. The release means continues to force the piston and, consequently, the slip housing upward to separate the loading nut from the releasable slip, thereby disengaging the releasable slip from the coiled tubing.

Another such means, described in U.S. Pat. No. 5,323,853, includes redundant releasing mechanisms depending alternatively on either hydraulic or electrical actuation of a piston. The additional lines and cables, which run inside the well bore that are required to actuate the release, have the disadvantage of creating an obstruction to fluid flow during normal drilling operations.

Another type of known release means depends for actuation on directing fluid flow so as to create backpressure and actuate a piston. U.S. Pat. No. 5,718,291 describes one such release mechanism that depends for actuation on either the use of backpressure created by flow through the mechanism, or if flow is prevented, the use of built-up pressure within a passage in the mechanism. In the first mode, backpressure created by flow through a restrictor above a shiftable sleeve overcomes a biasing spring to move the sleeve through a J-slot assembly until a passage is obstructed. Thereafter, pressure buildup in a second passage overcomes a shear pin, causing a piston to move and release dogs that lock two segments of the mechanism together. If flow is prevented, pressure buildup in the second passage causes the piston to move against the shifting sleeve to overcome the force of the spring and selectively move the sleeve through the J-slot assembly. A disadvantage of this release mechanism is that aligning the sleeve properly to engage the top of the J-slot assembly is cumbersome, requiring that pressure be created and removed by turning pumps on and off from the surface.

Still another conventional release device depends for actuation on dropping a ball into a well from the surface, sealing a flow passage, and building up pressure behind the ball to cause a disconnection. One such ball-drop release device is described in U.S. Pat. No. 5,419,399 and includes a housing with a slideable piston disposed within and releasably connected to the housing by shear screws. A ball is dropped into the well from the surface to seat with the upper end of the piston and block the flow passage, thereby creating pressure on a mandrel of the piston sufficient to overcome the shear screws. The mandrel moves downward such that keys align to fit into annular grooves on the mandrel to disengage notches, allowing the tubing to be disconnected from the drilling apparatus. A disadvantage of this device is that the operator must pull back or agitate the device to cause the keys to drop into the grooves should they fail to do so.

A further ball-drop release device is described in U.S. Pat. No. 5,526,888 and includes an upper and lower housing insertably connected and locked together by latch blocks, a slotted piston that operates the latch blocks, a pilot piston, and a lock-out mechanism operated by movement of the pilot piston. A sealing ball is dropped into the well and seats with the pilot piston to create a pressure differential sufficient to overcome shear pins, thereby allowing the pilot piston to axially shift downward. Movement of the pilot piston releases a lock-out mechanism such that the slotted piston extends axially to retract the latch blocks and thereby disconnect the upper and lower housings.

The present invention overcomes the deficiencies of the prior art.

SUMMARY OF THE INVENTION

The disconnect assembly of the present invention connects two portions of a downhole assembly having a downhole apparatus attached to a coiled tubing string. The disconnect assembly includes a first housing connected to one portion of the downhole assembly and a second housing connected to another portion of the downhole assembly. The housings are releasably connected by a release assembly. The release assembly is coupled to a drive train on a motor by a connection transferring rotational motion into translational motion. The release assembly includes locking members having a connected position engaging both housings and a disconnected position disengaging one of the housings. The motor is connected to the surface by conductors extending through the coiled tubing whereby the motor may be actuated from the surface to move the release assembly between the connected and released positions.

One embodiment features a selectively actuated disconnect assembly comprising: an outer housing; an inner housing having a cavity and disposed within the outer housing; a locking assembly disposed within the cavity for releasably locking the inner housing with the outer housing; an electrically actuatable power source housed in the cavity for actuating the locking assembly; a drive train coupled to the power source; and a connection coupling the locking assembly with the drive train for engaging and disengaging the locking assembly. In one embodiment of the invention, the disconnect assembly is disposed in a downhole assembly having a bottom hole assembly attached to a coiled tubing with conductors extending to the surface to an electric motor selectively actuatable from the surface; a lead screw having first and second ends and being coupled at the first end to the electric motor; a lead sleeve coupled to the first end of the lead screw and connected to a release shaft by a universal joint, the release shaft having an exterior surface with annular grooves and a plurality of locking pins disposed in transverse bores in the inner housing with one end disposed in the release shaft grooves in the unlock and released position and another end disposed in internal grooves about the outer housing in the locked and connected position.

The present invention also includes methods of disengaging a bottom hole assembly from coiled tubing, a method comprising: actuating an electric motor via a command signal; rotating a lead screw that is coupled to the electric motor and to a release shaft; axially moving the release shaft a distance sufficient to align grooves on the release shaft with the inner ends of radially extending pins, and moving the release shaft to cam the other ends of the pins out of the outer housing grooves.

In one embodiment of the present invention, the disconnect assembly used to release a portion of the downhole assembly above a stuck point. The disconnect assembly of the present invention is most useful in coiled tubing drilling operations. A plurality of these disconnect assemblies can be deployed at different positions in the downhole assembly. This allows selective actuation of one or more of the disconnect assemblies in the downhole assembly to release that disconnect assembly which is the closest to the stuck point, thereby minimizing the length of the downhole assembly to be fished out, greatly increasing the chance of a successful fishing operation, and minimizing the damages to the BHA components during fishing.

A feature of the invention is that the disconnect assembly has a common electrical and mechanical connection. Further, the disconnect assembly is selectively reconnectable. This allows an operator to activate the disconnect assembly in an attempt to remove the downhole assembly. If the downhole assembly remains stuck despite the disconnect assembly having been activated, the stuck point for the downhole assembly is likely up-hole from the disconnect assembly. The operator can signal the disconnect to reconnect. The operator can then activate a disconnect assembly up-hole from the initially activated disconnect assembly. Another feature of the invention is that it does not use a taper wedge lock mechanism, which is a simple and common employment for this type of application. However, a taper wedge lock tends to seize up and become self-locking after a long period of down hole vibration in drilling, which makes release operation difficult, if not impossible. The disconnect assembly of the present invention utilizes locking pins and a release shaft. Being round in geometry, it minimizes the chance of being self-locking to prevent release.

Thus, the present invention comprises a combination of features and advantages which enable it to overcome various deficiencies of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1A:
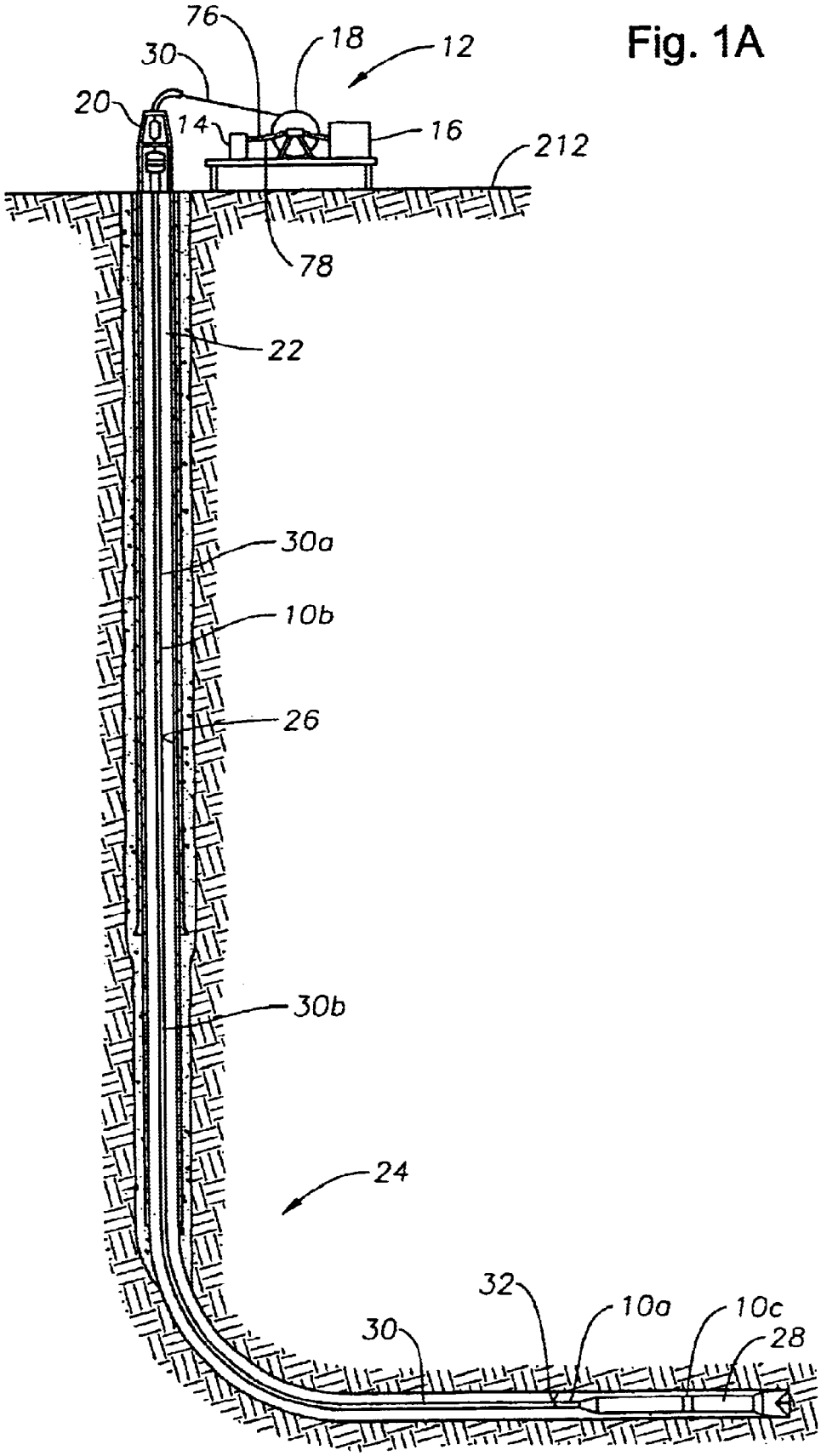
FIG. 1A is a schematic view of an example well with a downhole assembly.

The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

The downhole assembly of the present invention preferably includes a composite coiled tubing string attached to a bottom hole assembly. Various embodiments of the present invention provide a number of different constructions of the bottom hole assembly, each of which is used for a downhole operation in one of many different types of wells including a new well, an extended reach well, extending an existing well, a sidetracked well, a deviated borehole, and other types of boreholes. It should be appreciated that the bottom hole assembly may be only a downhole tool for performing an operation downhole in the well. Often the downhole operation relates to the drilling and completing of a pay zone in the well but the present invention is not limited to such operations. The embodiments of the present invention provide a plurality of methods for using the system of the present invention. It is to be fully recognized that the different teachings of the embodiments discussed below may be employed separately or in any suitable combination to produce desired results in a downhole operation. In particular the present system may be used in practically any type of downhole operation. Reference to "up" or "down" are made for purposes of ease of description with "up" meaning towards the surface and "down" meaning towards the bottom of the borehole. Use of the term "coupled" herein means a direct or indirect connection that can be permanent or selectively connectable. Thus, if a first device "couples" to a second device, that connection may be through a direct connection, or through an indirect connection via other devices and/or connections.

Referring initially to FIG. 1A, there is shown an exemplary operating environment for the disconnect assembly 10 of the present invention. At the surface, an operational system 12 includes a power supply 14, a surface processor 16, and a coiled tubing spool 18. An injector head unit 20 feeds and directs coiled tubing 30 from the spool 18 into the well 22. The downhole assembly 24 extending into the well 22 includes the coiled tubing string 26 and a bottom hole assembly 28. The bottom hole assembly 28 is shown attached to the lower end of composite coiled tubing string 26 and extending into a deviated or horizontal borehole 32. The lower end of the tubing string 26 may be connected to the bottom hole assembly 28 by a disconnect assembly 10*a*.

Although the coiled tubing 30 is preferably composite coiled tubing, hereinafter described, it should be appreciated that the present invention is not limited to composite coiled tubing and may be steel coiled tubing with electrical conductors mounted on the steel coiled tubing. The composite tubing string 26 may include a plurality of lengths 30*a* and 30*b* of composite coiled tubing. The adjacent ends of the lengths 30*a* and 30*b* of coiled tubing 30 may be connected by the disconnect assembly 10*b* of the present invention. In the preferred embodiment described, disconnect assembly 10*c* connects one set of components making up the bottom hole assembly with another set of components of the bottom hole assembly 28. It should be appreciated that this embodiment is described for explanatory purposes and that the present invention is not limited to a particular location in the downhole assembly. If a disconnect assembly 10 is not used to connect lengths 30*a*, 30*b* of composite coiled tubing 30 or to connect composite coiled tubing 30 to bottom hole assembly 28, one type of alternative connector is disclosed in U.S. patent application Ser. No. 09/534,685 filed Mar. 24, 2000 and entitled "Coiled Tubing Connector." It should be appreciated that the disconnect assembly 10 may be used in conjunction with the connector disclosed in the above identified application.

Figure 1B:
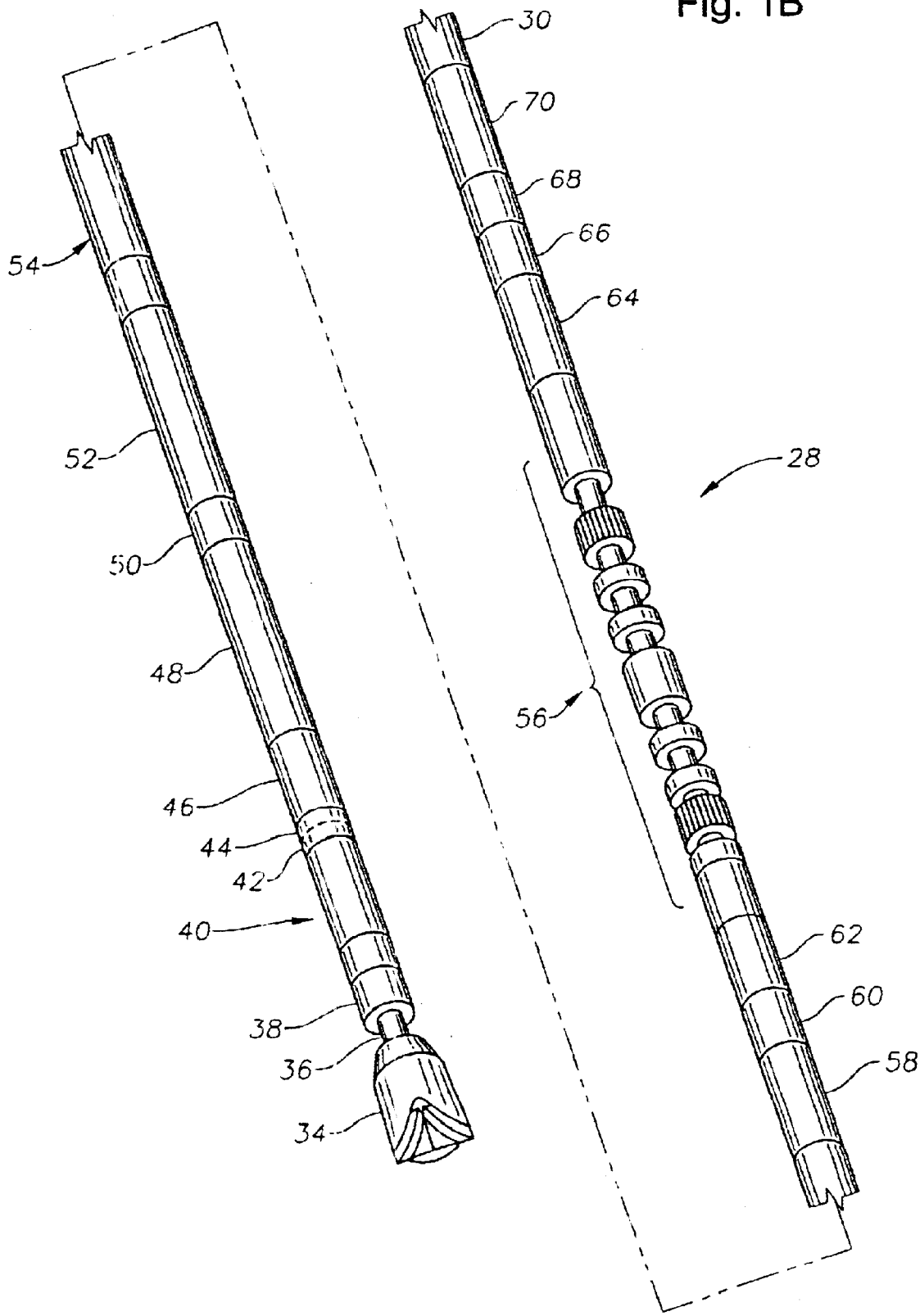
FIG. 1B is an enlarged view of the bottom hole assembly shown in FIG. 1A.

Referring now to FIG. 1B, there is shown one type of bottom hole assembly 28 made up of various components. Bottom hole assembly 28 has a first group of components including a bit 34 mounted on a drive shaft 36, a bearing assembly 38, a steering assembly 40 including an electronics section 42 and preferably a near bit orientation sensor 44 having an inclinometer and magnetometer, an upper constant velocity (CV) sub 46, a power section 48 with wire subs, a check valve 50, and a resistivity sub 52. The bottom hole assembly 28 also has a second group of components including a sensor sub 54 with an orientation package, additional sensors and downhole control devices, a propulsion system 56 including a lower tractor back pressure control module 58, a lower tension/compression sub 60, pressure measurement sub 62, an upper tractor back pressure control module 64, an upper tension/compression sub 66, and a supervisory sub 68.

Disconnect 10 releasably connects the first and second groups of components of bottom hole assembly 28 and in particular releasably connects the bit 34, steering assembly 40 and power section 48 with the propulsion system 56. If a disconnect 10 is not used to connect composite coiled tubing 30 to bottom hole assembly 28, one type of alternative connector is a flapper ball drop release 70. See for example U.S. patent application Ser. No. 09/504,569 filed Feb. 15, 2000 and entitled "Recirculatable Ball-Drop Release Device for Lateral Oilwell Drilling Applications", hereby incorporated herein by reference.

It should be appreciated that other tools may be included in the bottom hole assembly 10. The tools making up the bottom hole assembly 10 will vary depending on the operation to be conducted downhole. It should be appreciated that the present invention is not limited to a particular bottom hole assembly and other alternative assemblies may also be used. Further it should be appreciated that the disconnect 10 may be used to connect any two groups of components making up the bottom hole assembly 28.

Figure 2:
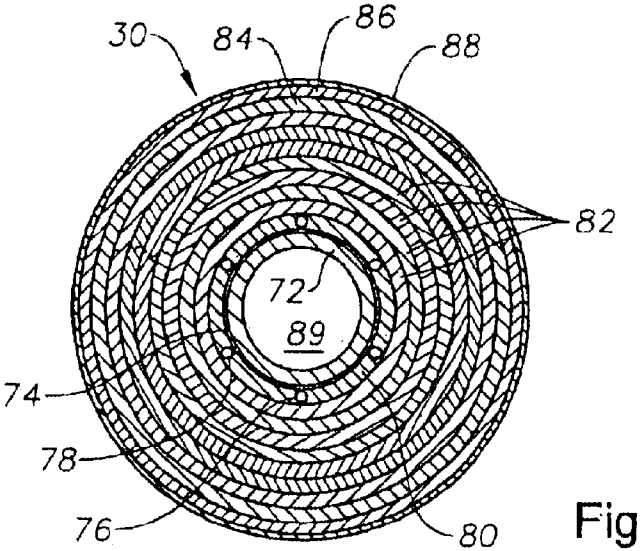
FIG. 2 is a cross-sectional view of the composite coiled tubing of FIGS. 1A and 1B showing conductors in the wall of the tubing.

Referring now to FIG. 2, the coiled tubing 30 making up the string 26 preferably includes a tube made of a composite material and includes an impermeable fluid liner 72, a layer of glass fiber 74, a plurality of conductors around the liner 72 and glass layer 74 including power conductors 76, 78 embedded in a protective resin 80, a plurality of load carrying layers 82 forming a carbon fiber matrix, a wear layer 84, a layer of polyvinylidene fluoride (PVDF) 86, and an outer wear layer 88 formed of glass fibers. Impermeable fluid liner 72 is an inner tube preferably made of a polymer, such as polyvinyl chloride or polyethylene, or any other material which can withstand the chemicals in the drilling fluids to be used in drilling the well 22 and the temperatures to be encountered downhole. The inner liner 72 is impermeable to fluids and thereby isolates the load carrying layers 74 from the drilling fluids passing through the flow bore 89 of liner 72. The load carrying layers 82 are preferably a resin fiber having a sufficient number of layers to sustain the required load of the string 26 suspended in fluid, including the weight of the string 26 and bottom hole assembly 28. The fibers of load carrying layers 82 are preferably wound into a thermal setting or curable resin. Load carrying fibers 82 provide the mechanical properties of the string 26. The wear layer 84 is preferably the outermost load carrying layer 82 and may be a sacrificial layer. Although only one wear layer 84 is shown, there may be additional wear layers as required. The PVDF layer 86 is impermeable to fluids and isolates the load carrying layers 82. The outer wear layer 88 is preferably the outermost layer of fiber and is a sacrificial layer. Composite coiled tubing is also described in U.S. patent application Ser. No. 09/081,961 filed May 20, 1998 and entitled "Well System", hereby incorporated herein by reference.

The power conductors 76, 78 housed within the composite tubing wall extend along the entire length of composite coiled tubing string 26 and are connected to bottom hole assembly 28. Conductors 76, 78 are connected to power supply 14 and to surface processor 16. Their downhole ends are connected to an electronics package in the bottom hole assembly 28. The conductors 76, 78 provide both power and command signals to the bottom hole assembly 28. Further data may also be communicated through the conductors 76, 78.

Figure 3:
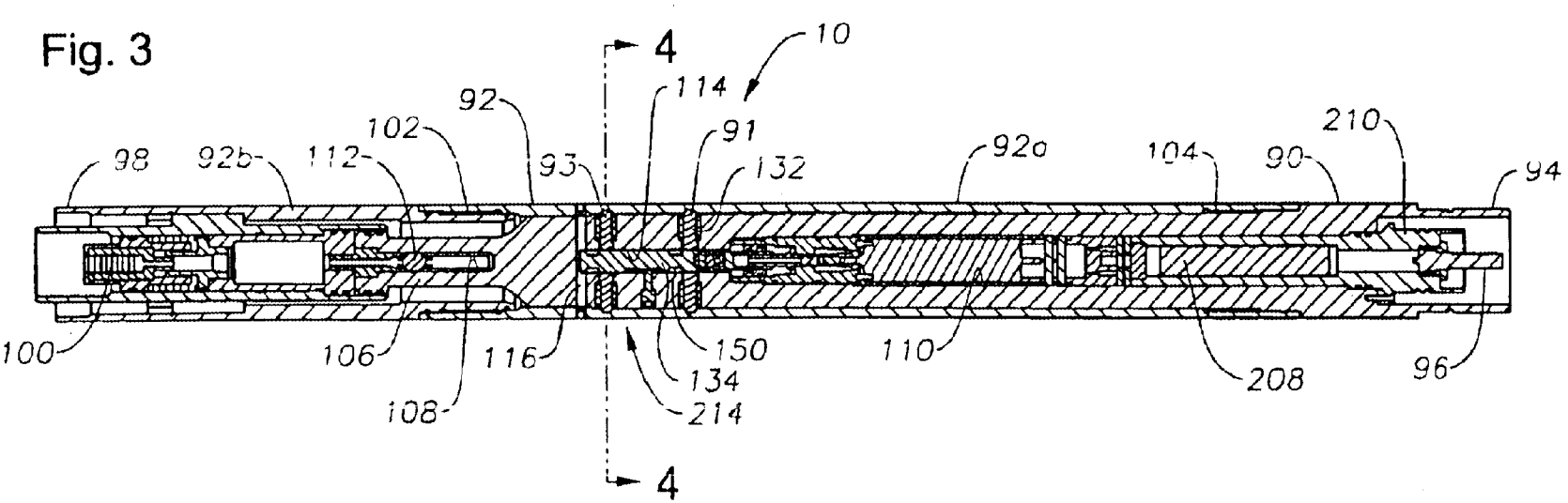
FIG. 3 is a longitudinal cross section of an embodiment of the disconnect assembly of the present invention in the connected position.
Figure 4:
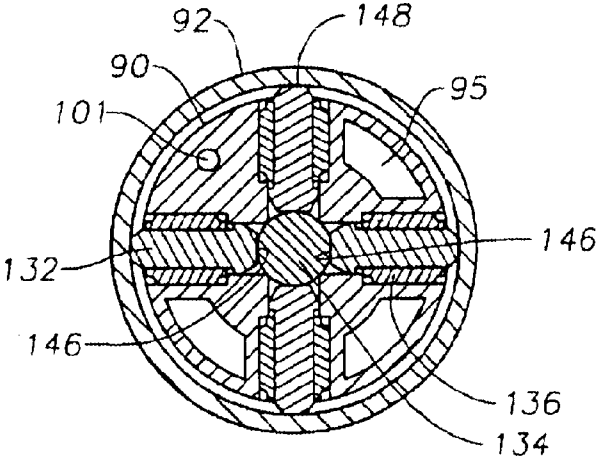
FIG. 4 is a cross sectional view along plane 4—4 in FIG. 3.

Referring now to FIGS. 3 and 4, there is shown a disconnect assembly 10 having an inner housing 90 and an outer housing 92. Inner housing 90 includes a threaded connection 94 for threaded engagement with the first grouping of BHA components and an electrical connection 96 for electrical connection to the first grouping of BHA components. A plurality of flow paths 95, best shown in FIG. 4, extend through the longitudinal length of inner housing 90 for the flow of drilling fluids. Outer housing 92 includes a threaded connection 98 for threaded engagement with the second grouping of BHA components and an electrical connection 100 for electrical connection to the second grouping of BHA components. The electrical connections are electrically connected to conductors 76, 78 in the wall of the composite tubing string 26 with conductors passing through passageways 101 extending longitudinally through the wall 128 of inner housing 90. Outer housing 92 includes uphole and downhole sections 92*a*, 92*b* threadingly connected at 102 to facilitate the assembly of housing 92 with inner housing 90. Outer housing 92 also has a pair of longitudinally spaced internal circumferential grooves 91, 93 on its inside diameter. Internal locking grooves 91, 93 have a rounded cross-section providing a camming surface. Inner housing 90 includes an upper fishing neck 106 having an electrical connector 108 making electrical connection with an electrical connector 112 mounted in the uphole section 92*b* of outer housing 92. Inner housing 90 releasably couples with outer housing 92, preferably via involute splines 104. Splines 104 transmit any torque transferred between inner and outer housings 90, 92.

Figure 5:
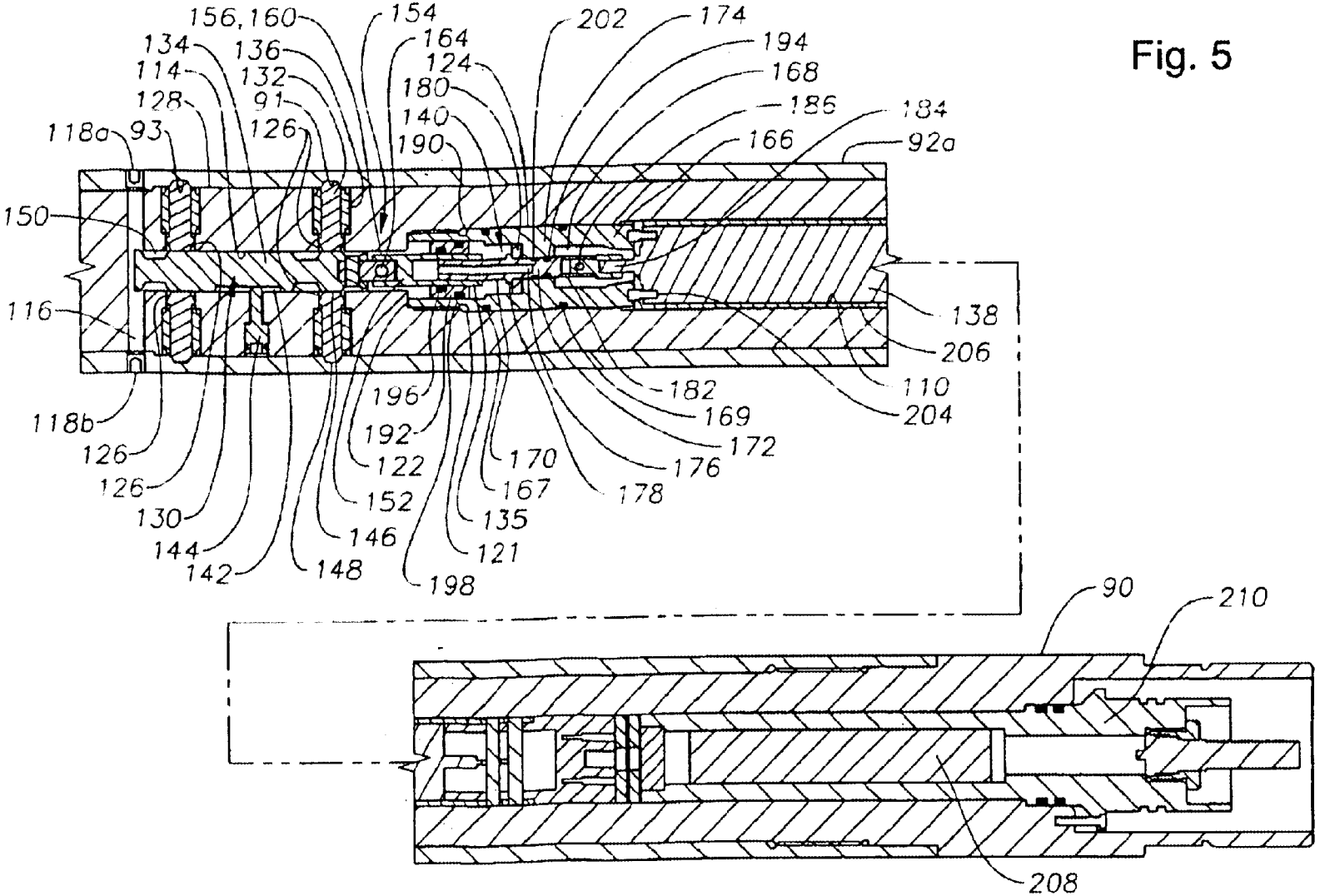
FIG. 5 is an enlarged view of a portion of the disconnect assembly shown in FIG. 3.
Figure 5A:
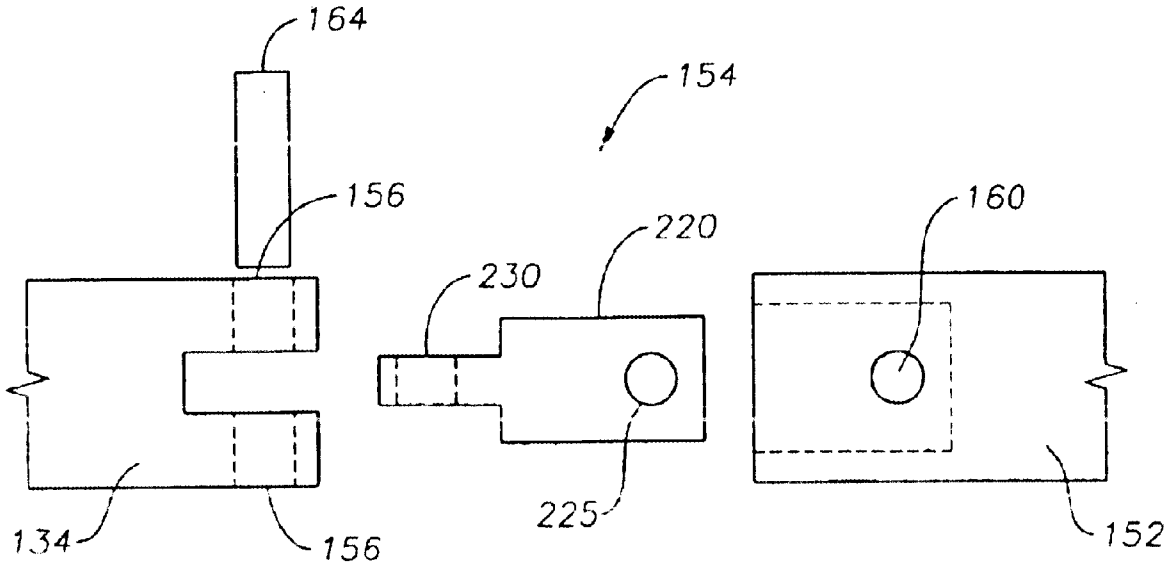
FIG. 5A is an enlarged exploded view of the universal joint shown in FIG. 5.
Figure 5B:
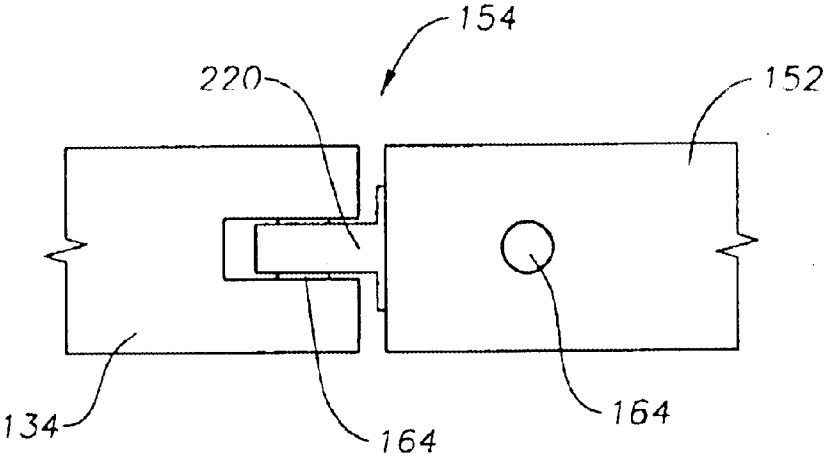
FIG. 5B is an enlarge view of the universal joint shown in FIGS. 5 and 5A.

Referring now to FIG. 5, inner housing 90 further includes an axially extending longitudinal cavity 110 with a reduced diameter uphole portion forming a bore 114. The uphole end of the bore 114 terminates at a transverse aperture 116 in alignment with plugged ports 118*a*, 118*b* in outer housing 92. The uphole bore 114 forms a downwardly facing annular shoulder 122. A medial reduced diameter portion of cavity 110 forms a reduced diameter cavity 120 disposed between bore 114 and the remainder 124 of cavity 110. Reduced diameter cavity 120 forms an annular shoulder 121. A plurality of transverse bores 126 extend from bore 114 through the outer wall 128 of inner housing 90.

A release assembly 130 is disposed within inner housing 90 and includes a plurality of locking pins 132 engaging a release shaft 134. Locking pins 132 are disposed in inner housing 90 by retainers 136 threaded into transverse bores 126. Release shaft 134 has its uphole end slidably received in reduced diameter bore 114 and its downhole end connected by a connection 135, hereinafter described, to a drive train 140 attached to an electric motor 138 housed in cavity 110, hereinafter described. Release shaft 134 has a longitudinally extending, elongated slot 142 therein which receives a guide pin 144 mounted in the wall 128 of inner housing 90 to prevent relative rotation between release assembly 130 and inner housing 90.

Each locking pin 132 has an inner and an outer end 146 and 148, respectively, and extends radially from release shaft 134 towards outer housing 92, best shown in FIG. 4. Release shaft 134 further comprises external circumferential release grooves 150 alignable with the inner pin ends 146 in the release position shown in FIG. 6 whereby locking pins 132 are received in release grooves 150. External release grooves 150 have a cross-section with a generally flat bottom and tapered sides. As shown in FIGS. 3–5, inner pin ends 146 are not aligned with external circumferential release grooves 150 in the connected position.

Still referring to FIGS. 3–5, 5A, and 5B release assembly 130 further includes a lead screw sleeve 152 connected to release shaft 134 by a universal joint 154. Universal joint 154 allows rotational movement between release shaft 134 and lead screw sleeve 152 to accommodate bending of the downhole assembly 24. Universal joint 154 is a coupling of preferably three pieces, namely release shaft 134, segment 220, and lead screw sleeve 152. Release shaft 134 has aperture 156, lead screw sleeve 152 has aperture 160 and segment 220 has apertures 225 and 230. When universal joint 154 is assembled (see FIG. 5B), aperture 156 and aperture 230 are aligned, and aperture 160 aperture 225 are aligned. Pins 164 are inserted into the apertures to prevent separation of release shaft 134 and lead screw sleeve 152.

The drive train 140 is supported within cavity 110 by a support sleeve 166 having a central aperture 168 therethrough with an annular restrictive flange 172 in the central portion thereof forming a bushing 174 therethrough for receiving the drive train 140. Seals 167, 169 are disposed between inner housing 90 and support sleeve 166. The drive train 140 includes a lead screw 170 threadingly received at one end by lead screw sleeve 152. Lead screw 170 includes a central blind bore 176 and an external annular bearing flange 178 engaging a bearing washer 180 disposed between annular restrictive flange 172 and annular bearing flange 178.

A converter 182 is coupled to drive shaft 184 of motor 138 at its downhole end and to lead screw 170 at its uphole end via a pin 186. Converter 182 rotates within the bushing 174 of the support sleeve 166. Seals 194 are disposed between bushing 174 and lead screw 170.

Support sleeve 166 has a flanged end 190. Flanged end 190 engages the annular shoulder 121. A pressure compensator piston 192 is disposed about lead screw sleeve 152 and within support sleeve 166. A seal 196 is disposed between lead screw sleeve 152 and pressure compensator piston 192, and seal 198 is disposed between piston 192 and support sleeve 166.

A lubricating fluid fills the space around release assembly 130 and drive train 140 including bore 114, lead screw sleeve 152, and central aperture 168. As the release assembly 130 and drive train 140 move, the lubricating fluid must be allowed to flow and not inhibit the movement of the release assembly 130 or drive train 140. Therefore an uphole pressure release port 200 is disposed adjacent the uphole end of release shaft 134 in transverse aperture 116 and a downhole pressure release ports 202 are disposed in central blind bore 176.

Electrical motor 138 is coupled via cap screws 204 to a retainer sleeve 206 mounted on an electronics package 208 disposed downhole of motor 138 in cavity 110. Electric motor 138 is connected through conductors 76, 78 to the surface 212 and can be commanded from the surface 212 to rotate in either clockwise or counterclockwise direction, i.e., either the release direction or the connect direction. A retainer 210 is threaded into the downhole end of cavity 110 to mount motor 138 and the electronics package 208 in cavity 110 of inner housing 90. Male electrical connector 96 extends through the retainer 210 connecting the electronics package 208 with the bottom hole assembly 28 threadingly connected to the downhole end 94 of inner housing 90. As best shown in FIG. 4, wire ways 101 extend longitudinally through the wall 128 of inner housing 90 to maintain an electrical connection from the surface 212 through the disconnect assembly 10 to the bottom hole assembly 28.

In operation, the electric motor 138 is actuated from the surface 212 causing drive shaft 184 to rotate drive train 140. As drive train 140 rotates, lead screw 170 rotates within lead screw sleeve 152. Depending upon the direction of rotation of the electric motor 138, the connection 135 causes release shaft 134 to either reciprocate towards or away from motor 138. Thus, upon command from the surface, electric motor 138 moves release shaft 134 either to the connecting position shown in FIGS. 3–5 or the releasing and released positions shown in FIGS. 6–7.

One or more of release shaft 134, locking pins 132, internal circumferential grooves 91, 93, and/or external circumferential grooves 150 comprise a lock 214 that is capable of releasably locking outer housing 92, connected to the second grouping of BHA components, to inner housing 90, connected to a first grouping of BHA components, while connection 146 serves a means for engaging and disengaging lock 214.

In the connected position as shown in FIGS. 3–5, locking pins 132 are aligned and disposed within internal circumferential grooves 91, 93 of outer housing 92 and carry the axial load between outer housing 92 and inner housing 90. Locking pins 132 are maintained in the locked position by release shaft 134.

Figure 6:
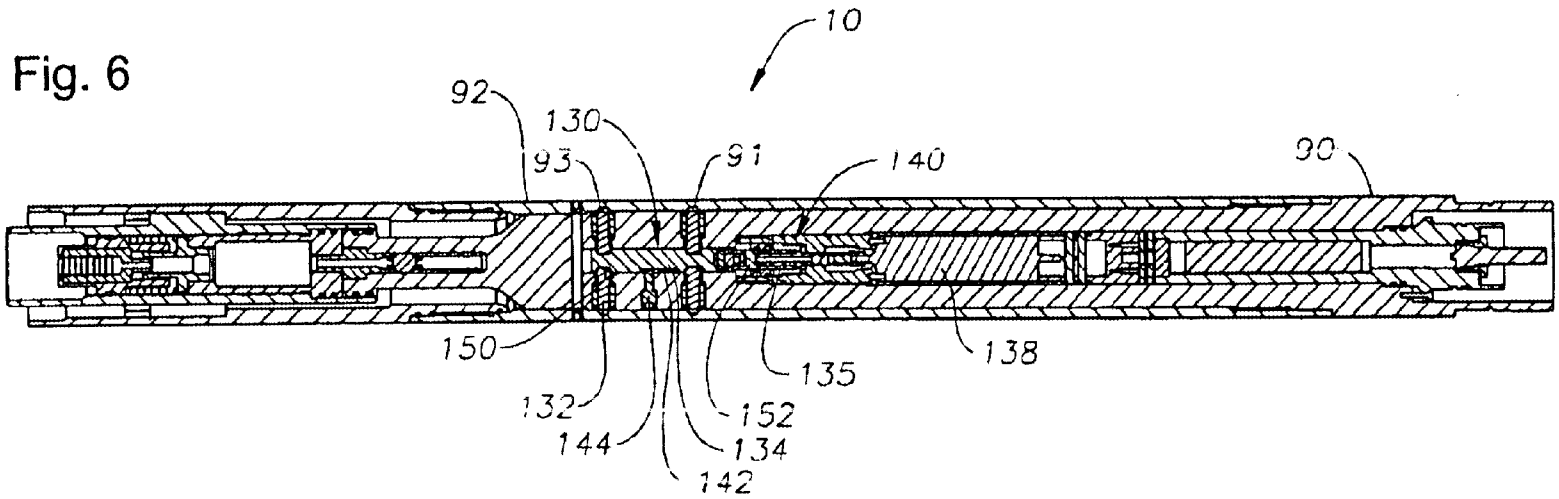
FIG. 6 is a longitudinal cross-sectional view of the disconnect assembly of FIGS. 3–5 in the released position.

FIG. 6 shows disconnect assembly 10 in the released position. Upon command from the surface, electric motor 138 actuates, thereby actuating and rotating lead screw 170. As lead screw 170 rotates within screw sleeve 152, release shaft 134 moves axially downhole by virtue of the threaded engagement between lead screw 170 and lead screw sleeve 152 forming connection 135. Thrust of lead screw 170 is taken by bearing flange 178 and bearing washer 180. As previously stated, guide pin 144 and longitudinally elongated slot 142 prevent relative rotation between shaft 134 and inner housing 90 causing release shaft 134 to move axially, but prevent release shaft 134 from rotating. As shown in FIG. 6, lead screw 170 has moved release shaft 134 axially such that external circumferential grooves 150 are now aligned with locking pins 132.

Still referring to FIG. 6, disconnect assembly 10 is shown in the released position after a command signal has been sent to electric motor 138 to disengage disconnect assembly 10. Actuation of motor 138 preferably occurs directly from the surface 212, preferably via conductors 76, 78 extending through the wall of composite coiled tubing string 26. For example, the operator can send a command signal to electric motor 138 directing motor 138 to disengage disconnect assembly 10. If there are multiple disconnect assemblies 10 used in downhole assembly 24, each disconnect assembly 10 is assigned a unique command address. The command from the surface 212 includes the command address of the disconnect assembly 10 to be disconnected. If the address of a particular disconnect assembly 10 matches the command signals, electric motor 138 of that disconnect assembly 10 is activated and rotates lead screw 170. When lead screw 170 is actuated by electric motor 138 in response to a disengage command, lead screw 170 axially pulls release shaft 134 toward electric motor 138. Once external circumferential grooves 150 align with locking pins 132, the released position of FIG. 6 occurs and pins 132 can move radially into external circumferential grooves 150. After pins 132 have moved out of internal circumferential grooves 91, 93 and into external circumferential grooves 150, disconnect assembly 10 is in the released a position and outer housing 92 is ready to be separated from inner housing 90 and pulled out of the hole while the inner housing 90 with the first grouping of BHA components remains in the borehole.

Figure 7:
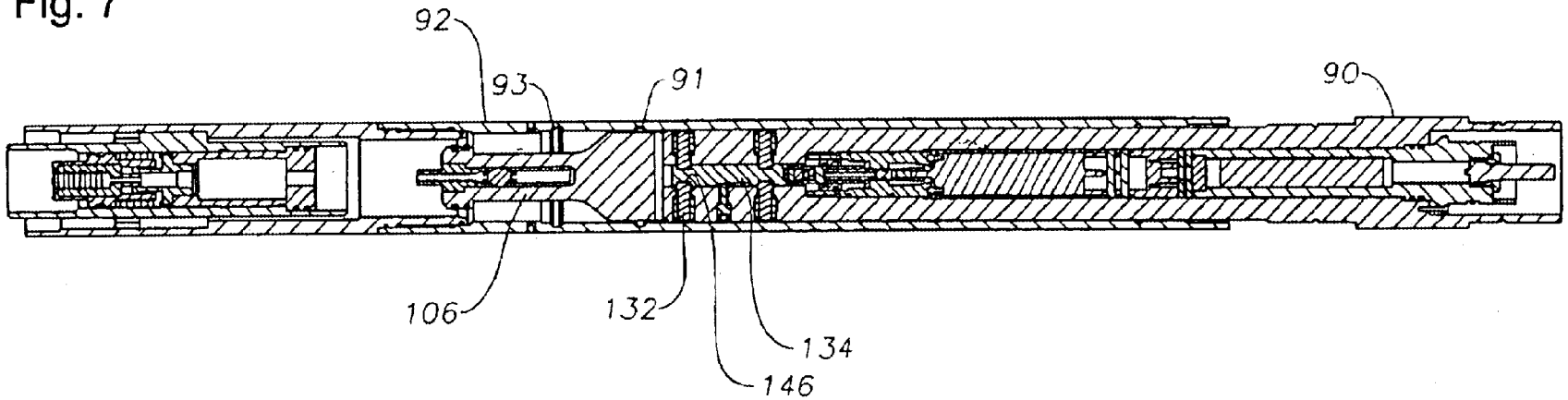
FIG. 7 is a longitudinal cross-sectional view of the disconnect assembly of FIGS. 3–5 in the disconnected position.

FIG. 7 shows outer housing 92 and inner housing 90 in the disconnected position. As shown, pins 132 have moved into external circumferential grooves 150 and outer housing 92 has been disconnected from inner housing 90. Outer housing 92 can then be pulled out of the borehole, leaving fishing neck 106 exposed uphole for a fishing operation to retrieve that portion of the BHA stuck in the borehole.

On occasions, outer housing 92 cannot be separated from inner housing 90 after disconnect assembly 10 being activated and placed in the released positions. This indicates that the stuck point for the downhole assembly 26 is up-hole from disconnect assembly 10. The present invention allows a command signal to be sent to electric motor 138 to turn lead screw 170 in the opposite direction, i.e., in the direction to push release shaft 134 axially away from electric motor 138. Release shaft 134 will then be moved axially until locking pins 132 are cammed radially outwards and outer ends 148 engage internal circumferential grooves 91, 93. This locks the tool for normal operation, as shown in FIGS. 3–5. The operator can now choose to activate another disconnect assembly 10 above the one just being activated to attempt a release further uphole.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A disconnect for well drilling operations from the surface, comprising:

a body;

a motor disposed on said body and being selectively actuatable from the surface;

a lead screw having one end coupled to said motor;

a release plunger coupled to another end of said lead screw; and a plurality of pins disposed about said release plunger on said body.

2. The disconnect of claim 1, further comprising:

said body having a cavity; and said motor, lead screw, and release plunger being disposed in said cavity.

3. The disconnect of claim 2, further including a housing having internal recesses adapted to receive one end of said pins and wherein said release plunger has external grooves adapted to receive another end of said pins.

4. The disconnect of claim 3, wherein said release plunger has an longitudinally elongated slot in which is slidingly disposed a guide pin on said body.

5. The disconnect of claim 4, wherein said release plunger includes a universal coupling joining first and second portions of said plunger, said second portion being coupled to said lead screw.

6. The disconnect of claim 5, further comprising a piston disposed about said release plunger.

7. The disconnect of claim 5, further comprising:

a first seal sealingly engaging said piston and said release plunger; and a second seal sealingly engaging said piston and said body.

8. The disconnect of claim 7, further comprising a pressure release disposed adjacent said first portion of said release plunger.

9. The disconnect of claim 7, wherein said body further comprises a fishing neck.

10. The disconnect of claim 9, further including a housing around said body, said body and housing having interengaging splines.

11. An electro-mechanical disconnect for a coiled tubing assembly, comprising:

a body having a cavity, said body capable of coupling to the coiled tubing;

an electric motor housed within said cavity;

a lead screw housed within said cavity, said lead screw having one end coupled to said electric motor;

a plunger housed within said cavity and coupled to another end of said lead screw, said plunger having at least one circumferential groove therearound; and at least one pin extending radially from said plunger and capable of moving into said external circumferential groove.

12. The disconnect of claim 11, further comprising coiled tubing telescopingly engaged with and coupling to said body, said coiled tubing having at least one internal circumferential groove.

13. The disconnect of claim 11, wherein said release plunger comprises a longitudinally elongated slot receiving a plunger guide pin on said body to prevent rotation of said plunger upon movement of said lead screw.

14. A disconnect for well drilling operations, comprising:

a housing having internal grooves; and a body disposed within said housing;

a plunger disposed in said body and having two external grooves and being capable of being moved among a drilling position, a release position, and a disengaged position;

a lead screw threadingly engaged with said plunger;

an electric motor coupled to said lead screw; and a plurality of pins mounted on said body and engaging said plunger.

15. A method of disengaging a bottom hole assembly from coiled tubing, comprising:

actuating an electric motor via an electrical command signal;

rotating a screw that is coupled to the electric motor and is threadingly coupled to a release plunger;

axially moving the release plunger a distance sufficient to align grooves on the plunger with radially extending pins.

16. The method of claim 15, further comprising continuing to axially move the release plunger until the outer ends of the radially extending pins disengage from respective grooves on the interior of the coiled tubing.

17. A method of disengaging a tool from coiled tubing, comprising:

sending an electric command signal to an electric motor in a body coupled to a section of the coiled tubing, the coiled tubing having channels on its interior;

actuating an electric motor in response to the electrical command signal;

rotating a mechanism coupled to the electric motor and to a release plunger;

preventing rotational movement of the release plunger; and axially moving the release plunger a distance sufficient to align grooves on the plunger with the inner ends of radially extending pins.

* * * * *